US008439194B2

(12) United States Patent
Spivey

(10) Patent No.: US 8,439,194 B2
(45) Date of Patent: May 14, 2013

(54) CARTON WITH INSERT

(75) Inventor: Raymond R. Spivey, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 13/115,273

(22) Filed: May 25, 2011

(65) Prior Publication Data

US 2011/0290692 A1 Dec. 1, 2011

Related U.S. Application Data

(60) Provisional application No. 61/396,269, filed on May 25, 2010.

(51) Int. Cl.
*B65D 85/00* (2006.01)

(52) U.S. Cl.
USPC ..... 206/427

(58) Field of Classification Search ..... 206/427, 206/433, 435, 434
See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |

(Continued)

FOREIGN PATENT DOCUMENTS

| | | |
|---|---|---|
| CA | 873185 A1 | 6/1971 |
| EP | 0 066029 | 12/1982 |

(Continued)

OTHER PUBLICATIONS

International Search Report and Written Opinion dated Oct. 25, 2011 for PCT/US2011/037872.

(Continued)

*Primary Examiner* — Steven A. Reynolds
*Assistant Examiner* — King M Chu
(74) *Attorney, Agent, or Firm* — Womble Carlyle Sandridge & Rice, LLP

(57) ABSTRACT

A carton for holding a plurality of containers. The carton comprises a plurality of panels that extends at least partially around an interior of the carton. The plurality of panels comprises a top panel, a first side panel foldably connected to the top panel, a bottom panel foldably connected to the first side panel, a second side panel foldably connected to the bottom panel, and a corner reinforcement flap foldably connected to the top panel. A reinforcing insert comprises a central panel and at least one reinforcing side flap. The central panel can be at least partially in face-to-face contact with at least a portion of the top panel. A container-restraining structure comprises the corner reinforcement flap positioned to restrain at least one container of the plurality of containers that is adjacent the second side panel.

25 Claims, 10 Drawing Sheets

U.S. PATENT DOCUMENTS 3,133,634 A 5/1964 Bozdar
3,173,596 A 3/1965 Aust et al.
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A 9/1975 Forrer
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A 12/1991 Wilson
5,101,642 A 4/1992 Alexandrov
5,119,985 A 6/1992 Dawson et al.
5,137,211 A 8/1992 Summer et al.
5,219,229 A 6/1993 Sengewald
5,246,112 A * 9/1993 Stout et al. ..... 206/427
5,249,681 A 10/1993 Miller
5,297,725 A 3/1994 Sutherland
5,320,277 A 6/1994 Stout et al.
5,333,734 A 8/1994 Stout et al.
5,350,109 A 9/1994 Brown et al.
5,425,474 A 6/1995 Dalea et al.
5,427,241 A * 6/1995 Sutherland ..... 206/427
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,639,017 A * 6/1997 Fogle ..... 229/117.14
5,664,683 A 9/1997 Brody
5,690,213 A 11/1997 Matsumura
5,690,230 A 11/1997 Griffith
5,704,470 A * 1/1998 Sutherland ..... 206/147
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 10/2001 Stout
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 * 11/2005 Schuster ..... 229/117.16
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland et al.
7,225,930 B2 6/2007 Ford et al.
7,422,104 B2 9/2008 Perkinson
7,478,743 B2 * 1/2009 Holley, Jr. ..... 229/103.2
7,604,157 B2 10/2009 Zammit et al.
7,699,163 B2 * 4/2010 Gomes et al. ..... 206/162
7,699,215 B2 * 4/2010 Spivey, Sr. ..... 229/240
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates
2003/0150759 A1 8/2003 White, Jr.
2003/0192907 A1 10/2003 Bates
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0126947 A1 6/2005 Holley et al.
2005/0167291 A1 8/2005 Sutherland
2005/0167478 A1 8/2005 Holley, Jr.
2005/0189405 A1 9/2005 Gomes et al.
2005/0263574 A1 12/2005 Schuster
2006/0054522 A1 3/2006 Kline et al.
2006/0081691 A1 4/2006 Smalley
2006/0091193 A1 5/2006 DeBusk et al.
2006/0118606 A1 6/2006 Holley, Jr. et al.
2006/0131370 A1 6/2006 Bates
2006/0175386 A1 8/2006 Holley, Jr.
2006/0231441 A1 * 10/2006 Gomes et al. ..... 206/427
2006/0231600 A1 10/2006 Holley
2006/0249413 A1 11/2006 Auclair et al.
2006/0278689 A1 12/2006 Boshinski et al.
2007/0007325 A1 * 1/2007 Suzuki et al. ..... 229/117.16
2007/0029371 A1 2/2007 Theelen
2007/0108261 A1 5/2007 Schuster
2007/0131748 A1 6/2007 Brand

| | | | | |
|---|---|---|---|---|
| 2007/0164093 | A1 | 7/2007 | Spivey et al. | |
| 2007/0181658 | A1 | 8/2007 | Sutherland | |
| 2007/0205255 | A1 | 9/2007 | Dunn | |
| 2007/0210144 | A1 | 9/2007 | Brand | |
| 2007/0251982 | A1 | 11/2007 | Brand | |
| 2007/0295790 | A1 | 12/2007 | Zammit et al. | |
| 2008/0023535 | A1 | 1/2008 | Holley, Jr. | |
| 2008/0048014 | A1 | 2/2008 | Bates | |
| 2008/0128479 | A1 * | 6/2008 | Bates et al. | 229/117.16 |
| 2009/0282843 | A1 | 11/2009 | Brand | |
| 2010/0044420 | A1 | 2/2010 | Brand | |
| 2010/0122999 | A1 | 5/2010 | Brand | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0290692 | A1 | 12/2011 | Spivey, Sr. | |

FOREIGN PATENT DOCUMENTS

| | | | |
|---|---|---|---|
| EP | 1 433 714 | A2 | 6/2004 |
| EP | 1 698 565 | A2 | 9/2006 |
| FR | 2 549 010 | | 1/1985 |
| GB | 2 264 101 | A | 8/1993 |
| JP | 2002-128064 | A | 5/2002 |
| JP | 2006-111342 | A | 4/2006 |
| JP | 2007-055630 | A | 3/2007 |
| JP | 2007-532421 | A | 11/2007 |
| JP | 2010-149927 | A | 7/2010 |
| KR | 10-0154124 | B1 | 2/1999 |
| KR | 10-0371048 | B1 | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | | 6/2005 |
| WO | WO 2005/100175 | A1 | 10/2005 |
| WO | WO 2006/050210 | A2 | 5/2006 |
| WO | WO 2006/050316 | A1 | 5/2006 |
| WO | WO 2007/076544 | A1 | 7/2007 |

OTHER PUBLICATIONS

International Search Report and Written Opinion dated Mar. 1, 2011 from PCT/US2010/041971.

International Search Report and Written Opinion dated May 30, 2011 from PCT/US2010/047102.

International Search Report and Written Opinion from PCT/US2010/027597 dated Oct. 27, 2010.

International Search Report and Written Opinion from PCT/US2011/051905 dated Apr. 23, 2012.

International Search Report and Written Opinion from PCT/US2011/055233 dated May 17, 2012.

Supplementary European Search Report from EP 10 75 4034 dated May 30, 2012.

International Search Report and Written Opinion for PCT/US2012/026050 dated Sep. 21, 2012.

* cited by examiner

CARTON WITH INSERT

CROSS-REFERENCE TO RELATED APPLICATIONS

This application claims the benefit of U.S. Provisional Patent Application No. 61/396,269, filed May 25, 2010.

INCORPORATION BY REFERENCE

The disclosure of U.S. Provisional Patent Application No. 61/396,269, which was filed on May 25, 2010, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having an insert.

SUMMARY OF THE DISCLOSURE

In general, one aspect of the disclosure is directed to a carton for holding a plurality of containers. The carton comprises a plurality of panels that extends at least partially around an interior of the carton. The plurality of panels comprises a top panel, a first side panel foldably connected to the top panel, a bottom panel foldably connected to the first side panel, a second side panel foldably connected to the bottom panel, and a corner reinforcement flap foldably connected to the top panel. A reinforcing insert comprises a central panel and at least one reinforcing side flap. The central panel can be at least partially in face-to-face contact with at least a portion of the top panel. A container-restraining structure comprises the corner reinforcement flap positioned to restrain at least one container of the plurality of containers that is adjacent the second side panel.

In another aspect, the disclosure is generally directed to, in combination, a carton blank and an insert blank for forming a carton having container-restraining features for restraining movement of containers in the carton. The carton blank comprises a plurality of panels comprising a top panel, a first side panel foldably connected to the top panel, a bottom panel foldably connected to the first side panel, a second side panel foldably connected to the bottom panel, and a corner reinforcement flap foldably connected to the top panel. The insert blank comprises a central panel and at least one reinforcing side flap foldably connected to the central panel. The central panel is for being positioned at least partially in face-to-face contact with at least a portion of the top panel. The container-restraining features comprise the corner reinforcement flap, which is for being positioned to restrain at least one container that is adjacent the second side panel in the carton formed from the carton blank and the insert blank.

In another aspect, the disclosure is generally directed to a method of forming a carton comprising obtaining a carton blank comprising a plurality of panels comprising a top panel, a first side panel foldably connected to the top panel, a bottom panel foldably connected to the first side panel, a second side panel foldably connected to the bottom panel, and a corner reinforcement flap foldably connected to the top panel. The method further comprises obtaining an insert blank comprising a central panel and at least one reinforcing side flap foldably connected to the central panel, and positioning the insert blank relative to the carton blank so that the central panel overlaps at least a portion of the top panel. The method further comprises forming an interior of the carton at least partially defined by the plurality of panels, and forming a container-restraining structure comprising the corner reinforcement flap. The forming the container-restraining structure comprises positioning the corner reinforcement flap for restraining at least one container adjacent the second side panel in the interior of the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
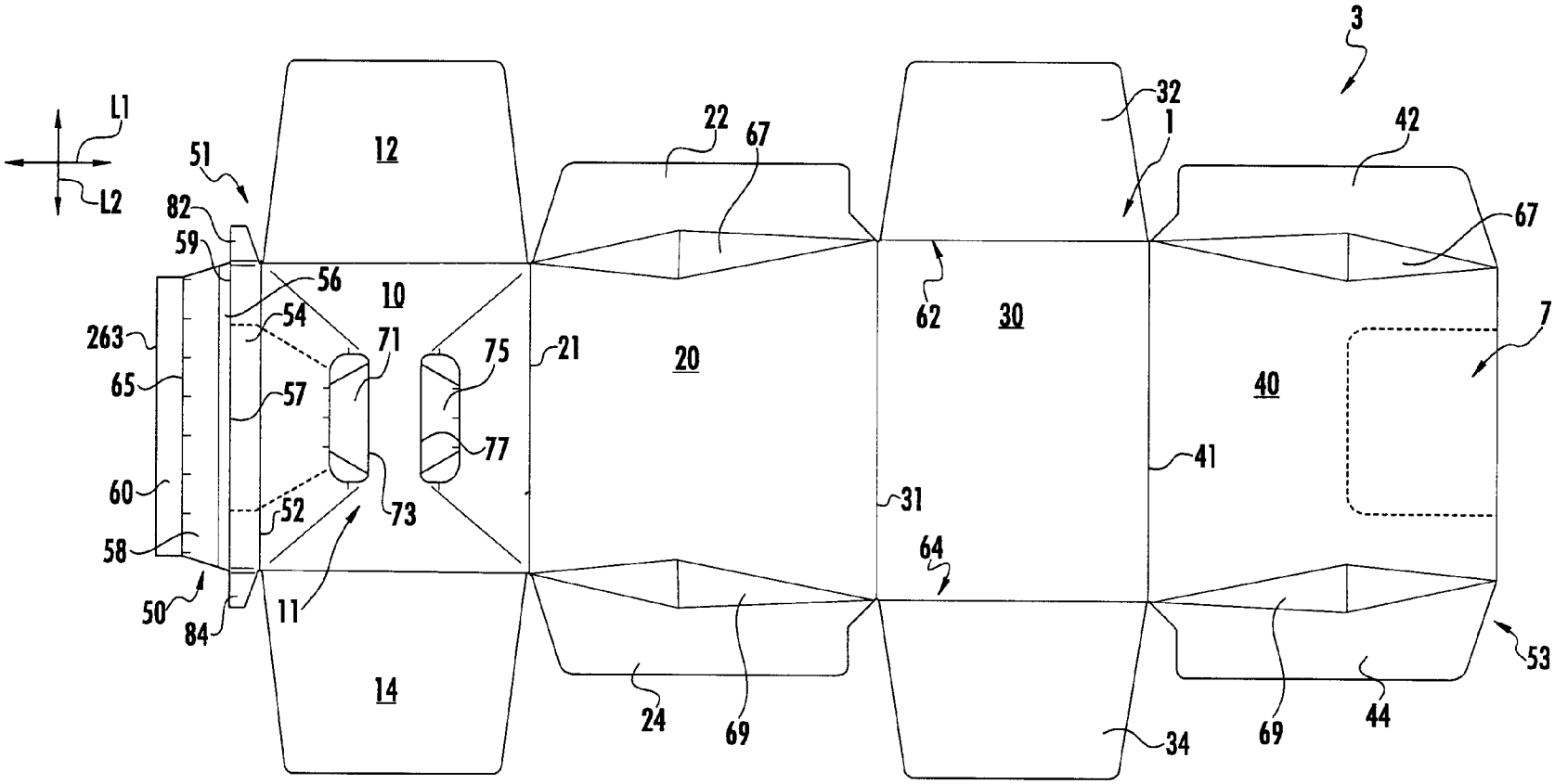
FIG. 1 is an exterior plan view of a carton blank for forming a carton according to one exemplary embodiment of the disclosure.
Figure 9:
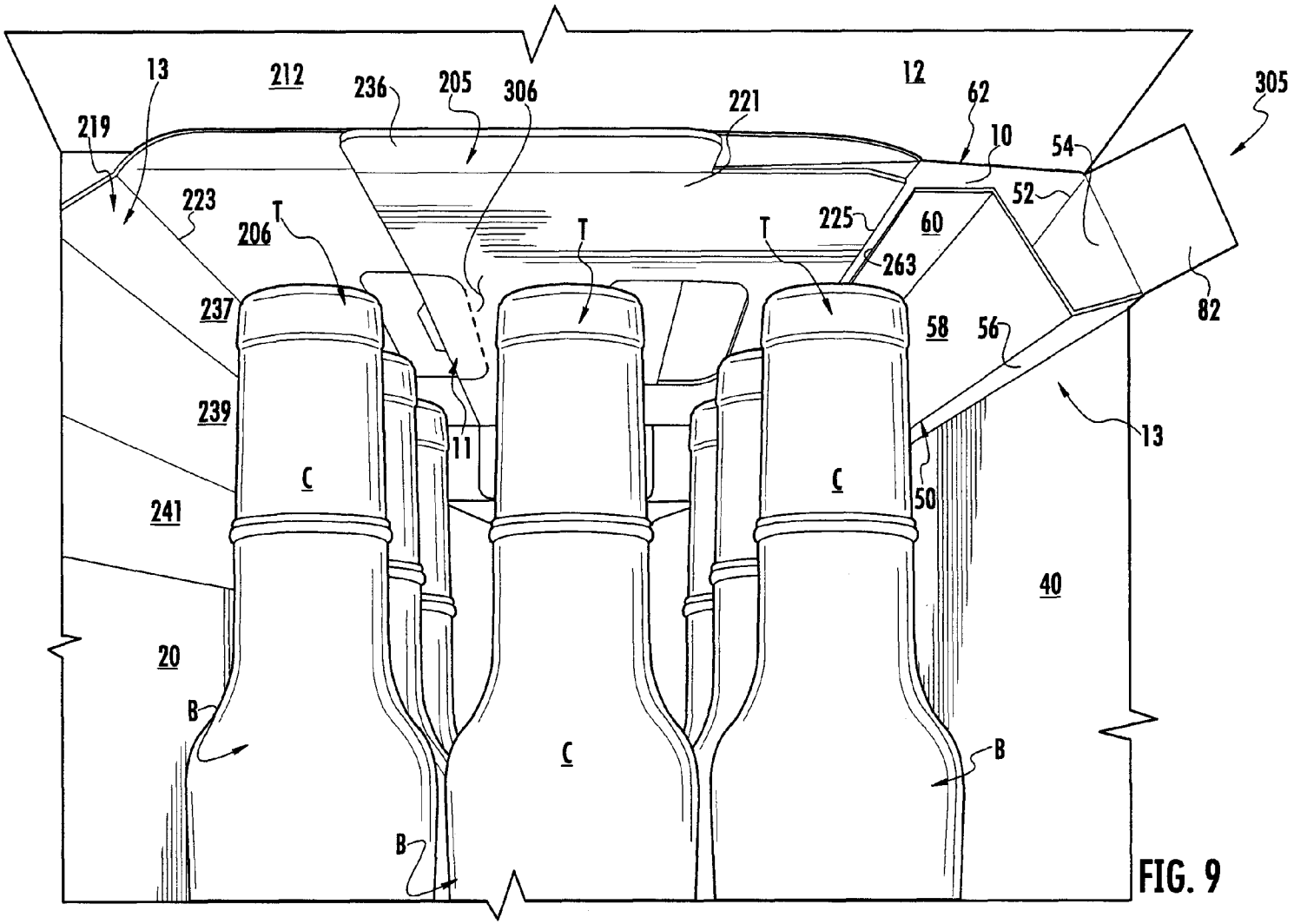

FIG. 1 is a plan view of the exterior side 1 of a carton blank, generally indicated at 3, used to form a carton 5 (FIG. 10) according to one exemplary embodiment of the disclosure. The carton 5 can be used to house a plurality of articles, such as containers C (FIG. 9). In the illustrated embodiment, the carton 5 is sized to house twelve containers C in a single layer in a 3×4 arrangement, though only nine of the twelve containers are shown in the carton in FIG. 9. It is understood that the carton 5 may be sized and shaped to hold containers of a different or same quantity in more than one layer and/or in different row/column arrangements (e.g., 1×6, 3×6, 2×6×2, 4×5, 3×5, 2×9, 2×6, 3×3, etc.). In one embodiment, the carton 5 has a dispenser 7 for accessing the containers C in the carton. In the illustrated embodiment, the carton 5 includes a handle, generally indicated at 11, for grasping and carrying the carton. As will be discussed below in more detail, the carton 5 includes an insert 205 formed from an insert blank 203 for reinforcing the carton. In addition, features of the insert blank 203 and the carton blank 3 form a container-restraining structure 13 for restraining the movement of the containers C.

As shown in FIG. 1, the carton blank 3 has a longitudinal axis L1 and a lateral axis L2. The carton blank 3 comprises a top panel 10 foldably connected to a first side panel 20 at a first lateral fold line 21. A bottom panel 30 is foldably connected to the first side panel 20 at a second lateral fold line 31. A second side panel 40 is foldably connected to the bottom panel 30 at a third lateral fold line 41.

In the illustrated embodiment, the carton blank 3 includes a corner reinforcement flap 50 foldably connected to the top panel 10 at a fourth lateral fold line 52. The corner reinforcement flap 50 comprises four panels or portions 54, 56, 58, 60 that are independently positionable at respective fold lines 52, 57, 59, 65. In the illustrated embodiment, the first portion 54 of the corner reinforcement flap 50 has corner end flaps 82, 84. The corner reinforcement flap 50 could be otherwise shaped, arranged, and/or configured without departing from the disclosure. In alternative embodiments, the carton blank 3 can be arranged so that the top panel 10 is foldably connected to both the first and second side panels 20, 40, or the blank 3 can have other alternative panel arrangements.

The top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. When the carton 5 is erected, the top and bottom end flaps 12 and 32, the side end flaps 22 and 42, and the corner end flap 82 close a first end 51 of the carton, and the top and bottom end flaps 14 and 34, the side end flaps 24 and 44, and the corner end flap 84 close a second end 53 of the carton. In accordance with an alternative embodiment of the present disclosure, different flap arrangements can be used for at least partially closing the ends 51, 53 of the carton 5.

The top and bottom end flaps 12 and 32 and side end flaps 22 and 42 extend along a first marginal area of the carton blank 3, and are foldably connected at a first longitudinal fold line 62 that extends along the length of the blank. The top and bottom end flaps 14 and 34 and side end flaps 24 and 44 extend at least partially along a second marginal area of the carton blank 3, and are foldably connected at a second longitudinal fold line 64 that also extends at least partially along the length of the blank. The longitudinal fold lines 62, 64 may be, for example, substantially straight, or offset at one or more locations to account for blank thickness or for other factors.

Figure 10:
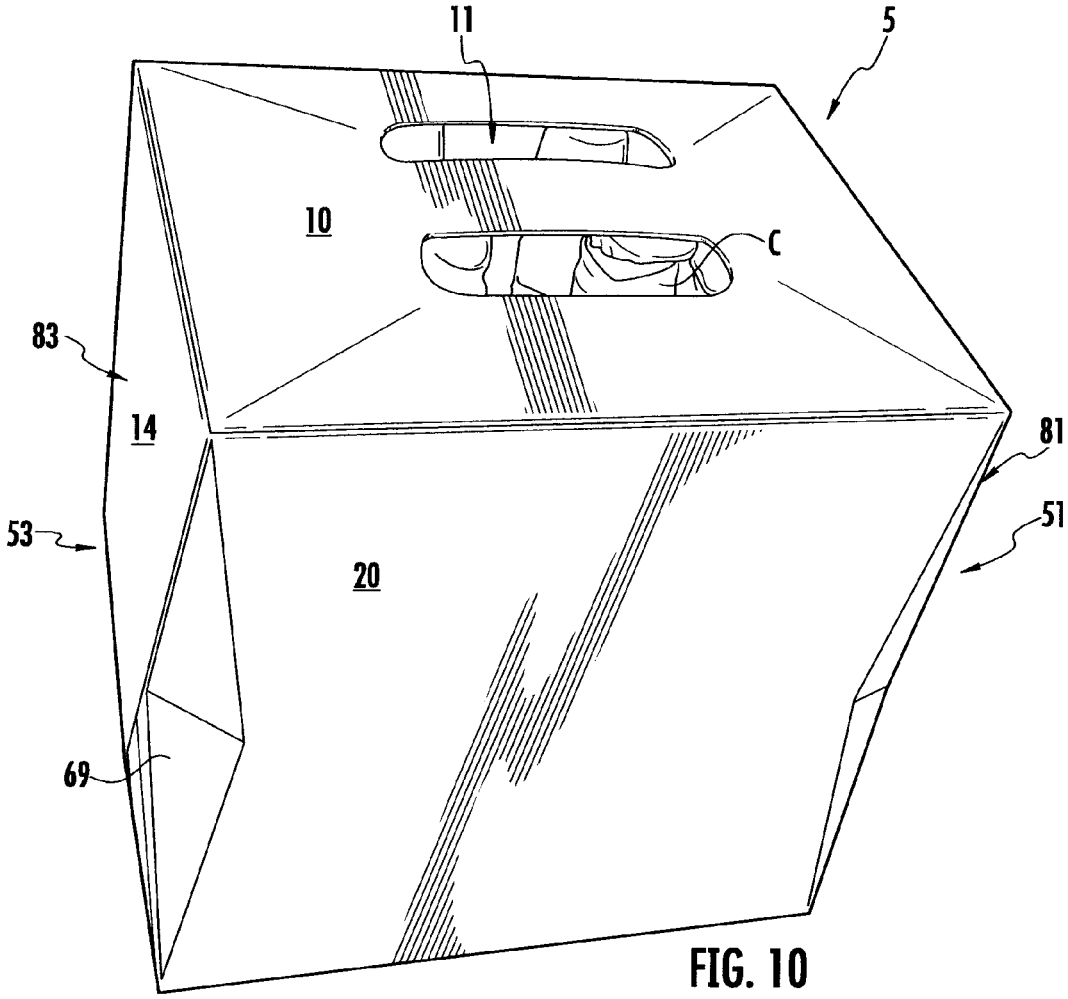
FIG. 10 is a perspective view of the erected carton according to the exemplary embodiment of the disclosure.

In the illustrated embodiment, the carton blank 3 includes features to form the carton 5 having tapered ends 51, 53. That is, the blank includes diamond corner panels 67, 69 that connect respective side end flaps 22, 42, 24, 44 to a respective one of the first side panel 20 and the second side panel 40. The diamond corner panels 67, 69 are configured to allow the top end flaps 12, 14 and the portions of the side end flaps 22, 42, 24, 44 in contact with the respective top flaps 12, 14 (e.g., the upper portions of the side end flaps) at the respective ends 51, 53 to taper inwardly to the top panel 10. The bottom panel 30 is longer in the L2 direction than the top panel 10. Accordingly, the containers C having a wide bottom B and narrow top T can be tightly held in the carton. Particularly, the bottoms B of the containers C adjacent the side panels 20, 40 and the ends 51, 53 are restrained by the respective side panels and ends, and the tops T adjacent the ends 51, 53 are restrained by the respective tapered upper portions 81, 83 of the respective ends 51, 53 (FIG. 10). In alternative embodiments, the carton 5 could be otherwise shaped, arranged, and/or configured. For example, the ends 51, 53 can taper inwardly from a respective edge of the bottom panel 30 to a respective edge of the top panel 10, any suitable portion of the ends 51, 53 can taper inwardly, or the ends can extend generally vertically.

As shown in FIG. 1, the features that form the handle 11 of the carton 5 include a first elongate handle flap 71 foldably connected to the top panel 10 at a lateral fold line 73, and a second elongate handle flap 75 foldably connected to the top panel at a lateral fold line 77. The handle 11 may be otherwise shaped and located in the carton 5 without departing from the scope of this disclosure.

Figure 2:
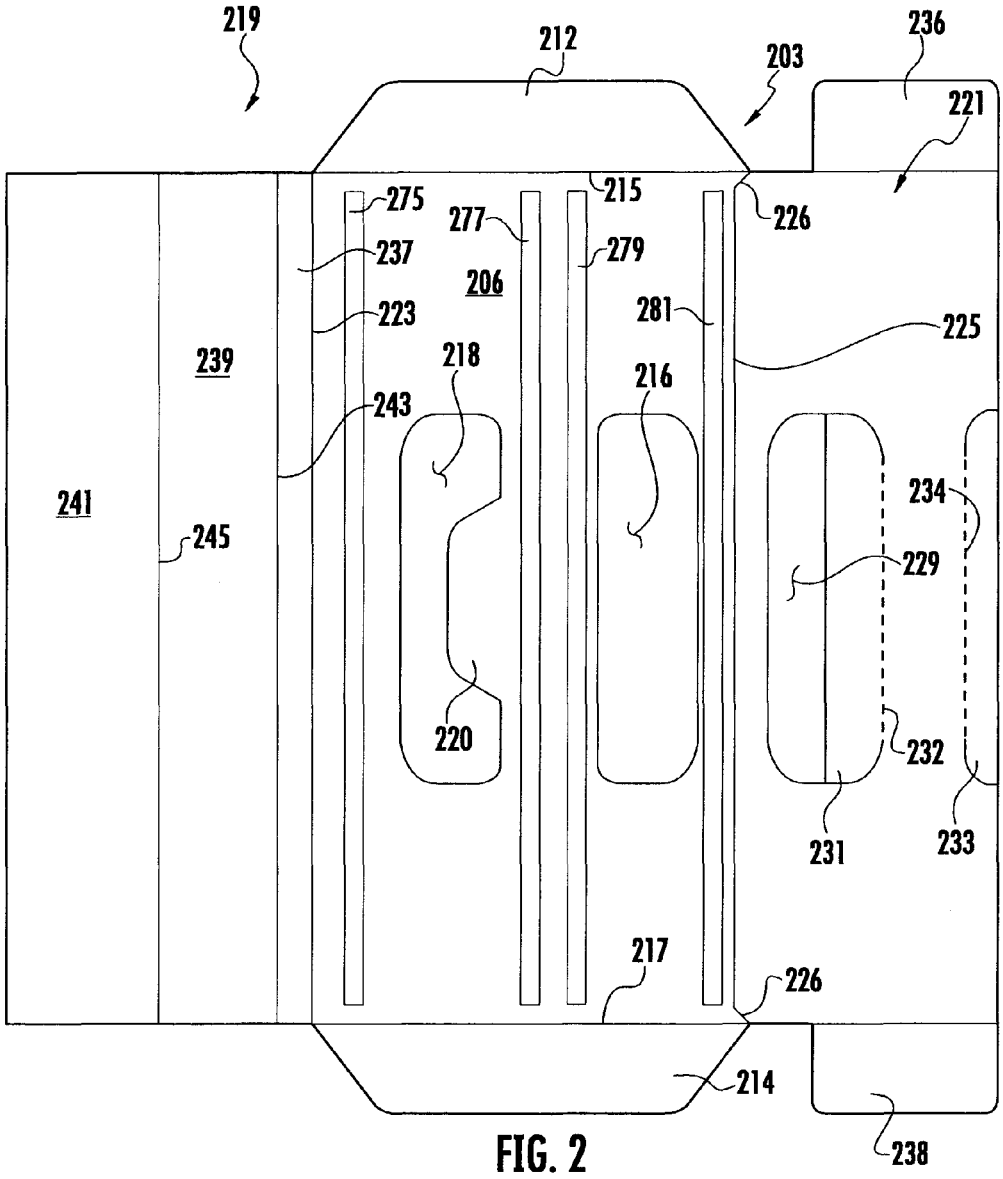
FIG. 2 is a plan view of an insert blank for forming a reinforcing insert according to the exemplary embodiment of the disclosure.

FIG. 2 illustrates the insert blank 203 used to form the reinforcing insert 205 (FIG. 8) for use in the carton 5. In the illustrated embodiment, the insert blank 203 includes a central panel 206, two reinforcing end flaps 212, 214 respectively foldably connected to the central panel 206 at respective fold lines 215, 217 at opposite ends of the central panel 206. The central panel 206 has two handle openings 216, 218 with a tab 220 extending adjacent the handle opening 218. The insert blank 203 has a first reinforcing side flap 219 and a second reinforcing side flap 221 foldably connected to the central panel 206 at respective fold lines 223, 225 at opposite sides of the central panel 206. The second reinforcing side flap 221 is further defined by two cuts 226 at respective ends of the fold line 225.

Figure 4:
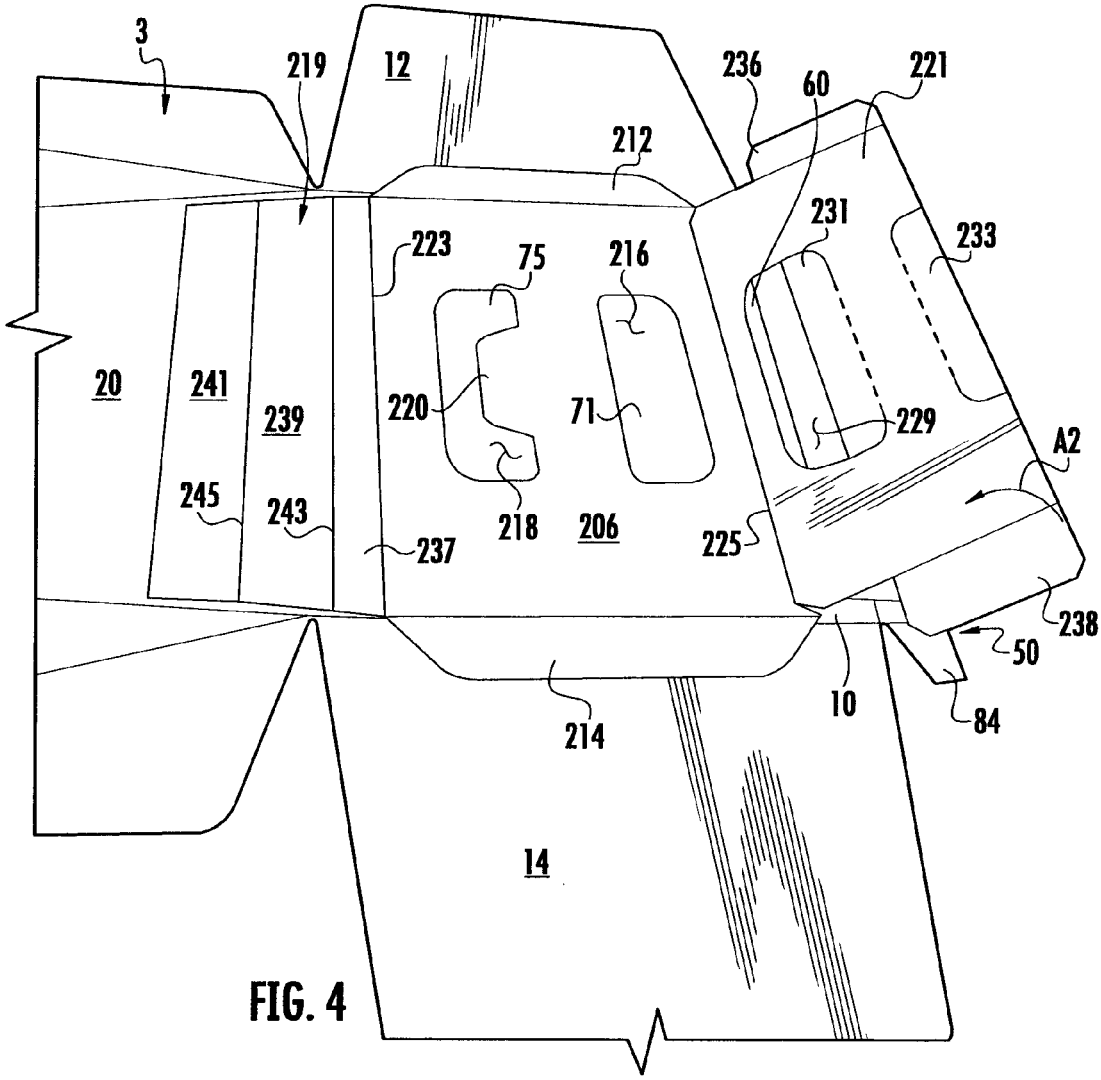

In the illustrated embodiment, the second reinforcing side flap 221 has a handle opening 229 with a first handle flap 231 foldably connected to the second reinforcing side flap 221 along a fold line 232. A second handle flap 233 is foldably connected to the second reinforcing side flap 221 at a fold line 234. The handle openings 216, 218 in the central panel 206 and the handle opening 229 and the handle flaps 231, 233 in the second reinforcing side flap 221 cooperate with the handle flaps 71, 75 in the top panel 10 to form the handle 11 (FIG. 4). The second reinforcing side flap 221 can further include two inner reinforcing end flaps 236, 238 foldably connected to the second reinforcing side flap 221 along the respective fold lines 215, 217. In the illustrated embodiment, the first reinforcing side flap 219 comprises three panels or portions, including a proximal portion 237, an intermediate portion 239, and a distal portion 241, that are independently positionable at respective fold lines 243, 245. In alternative embodiments, the reinforcing insert 205 could be otherwise shaped, arranged, and/or configured.

Figure 3:
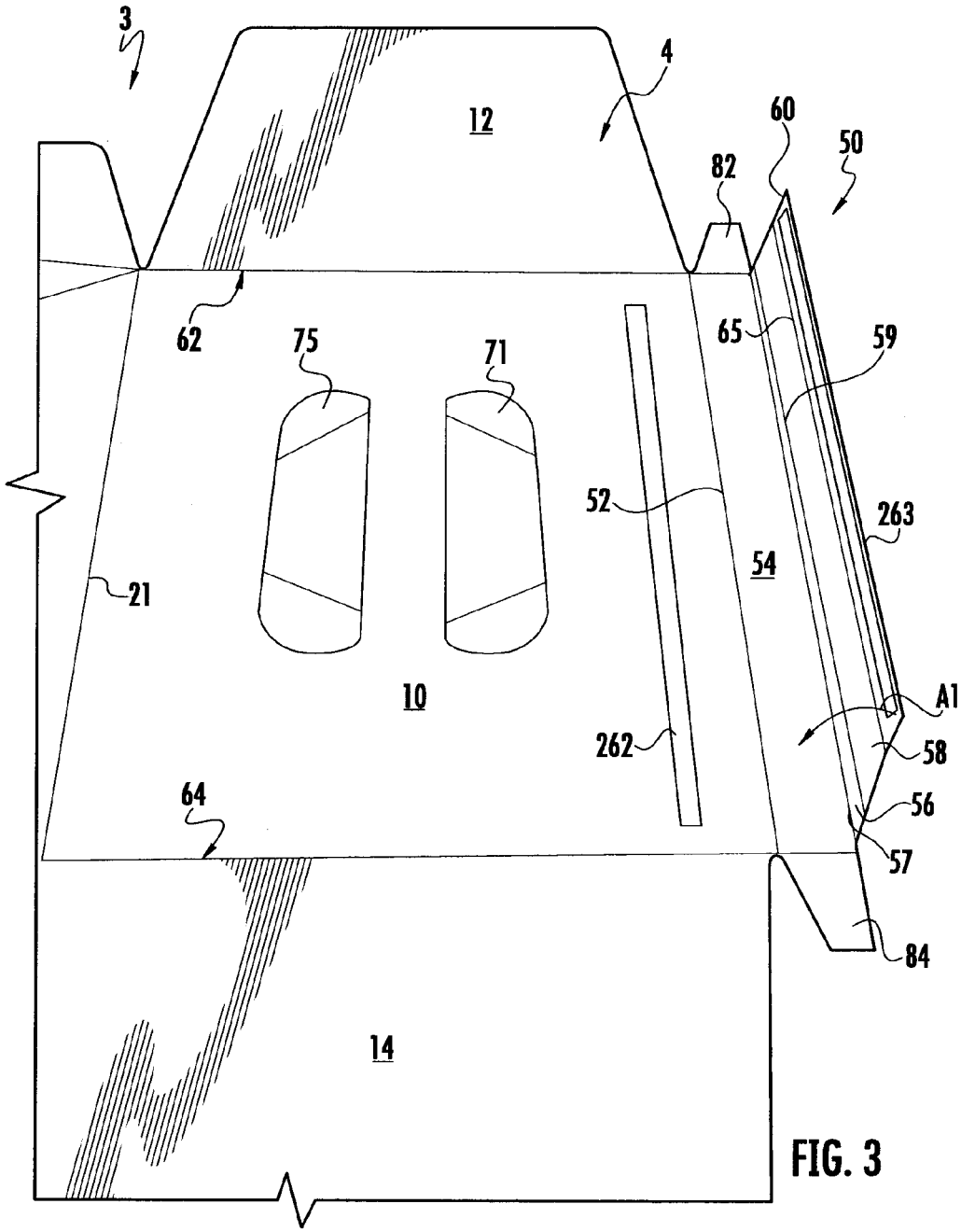
FIGS. 3-7 are perspective views of the insert blank of FIG. 2 and the carton blank of FIG. 1 in various stages of formation of the carton according to the exemplary embodiment of the disclosure.
Figure 5:
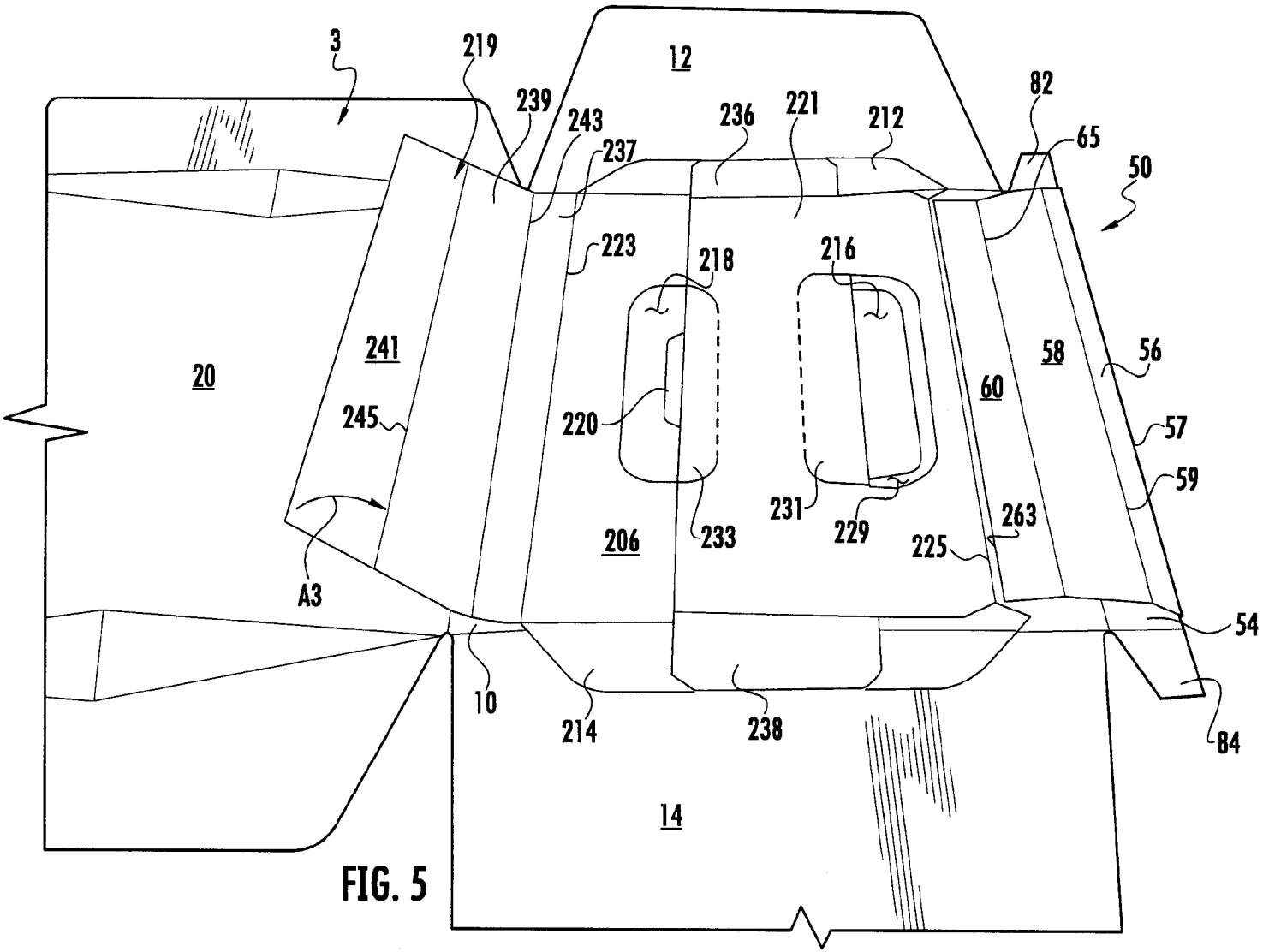

As shown in FIGS. 3-9, in one exemplary embodiment, the carton 5 can be assembled by adhering the end flap portion 60 of the corner reinforcement flap 50 to the top panel 10 with the application of glue 262 (FIG. 3). The corner reinforcement flap 50 is folded about fold line 57 in the direction of arrow A1 (FIG. 3) so that the end flap portion 60 is in face-to-face contact with the top panel 10 (FIG. 5). As shown in FIG. 4, the insert blank 203 is adhered to the top panel 10 of the carton blank 3 on an interior surface 4 of the carton blank. Glue can be applied in strips 275, 277, 279, 281 (FIG. 2) to the interior surface of the central panel 206 prior to placing the insert blank 203 in face-to-face contact with the top panel 10. The insert blank 203 is positioned on the top panel 10 so that the fold line 225 is adjacent the free edge 263 (FIG. 5) of the end flap portion 60 of the corner reinforcement flap 50 and the handle openings 216, 218 are generally aligned with the respective handle flaps 71, 75 in the top panel 10. The insert blank 206 can be alternatively secured to the top panel 10 without departing from the disclosure.

In the illustrated embodiment, the insert blank 203 is attached to the top panel 10 of the carton blank in a manner that keeps the reinforcing side flaps 219, 221 free from attachment to the carton blank 3. As shown in FIG. 4, the second reinforcing side flap 221 is folded about fold line 225 in the direction of arrow A2 so the second reinforcing side flap 221 is in face-to-face contact with the central panel 206. The second reinforcing side flap 221 can be adhered to the central panel 206 with the handle opening 229 and the handle flap 231 are generally aligned with the handle opening 216 in the center panel 206 and the handle flap 71 in the top panel 10. The handle flap 233 in the second reinforcing side flap 221 is generally aligned with the handle opening 218 in the central panel 206 and the handle flap 73 in the top panel 10. Accordingly, the central panel 206 and the second reinforcing side flap 221 reinforce the handle 11 of the carton 5.

Figure 6:
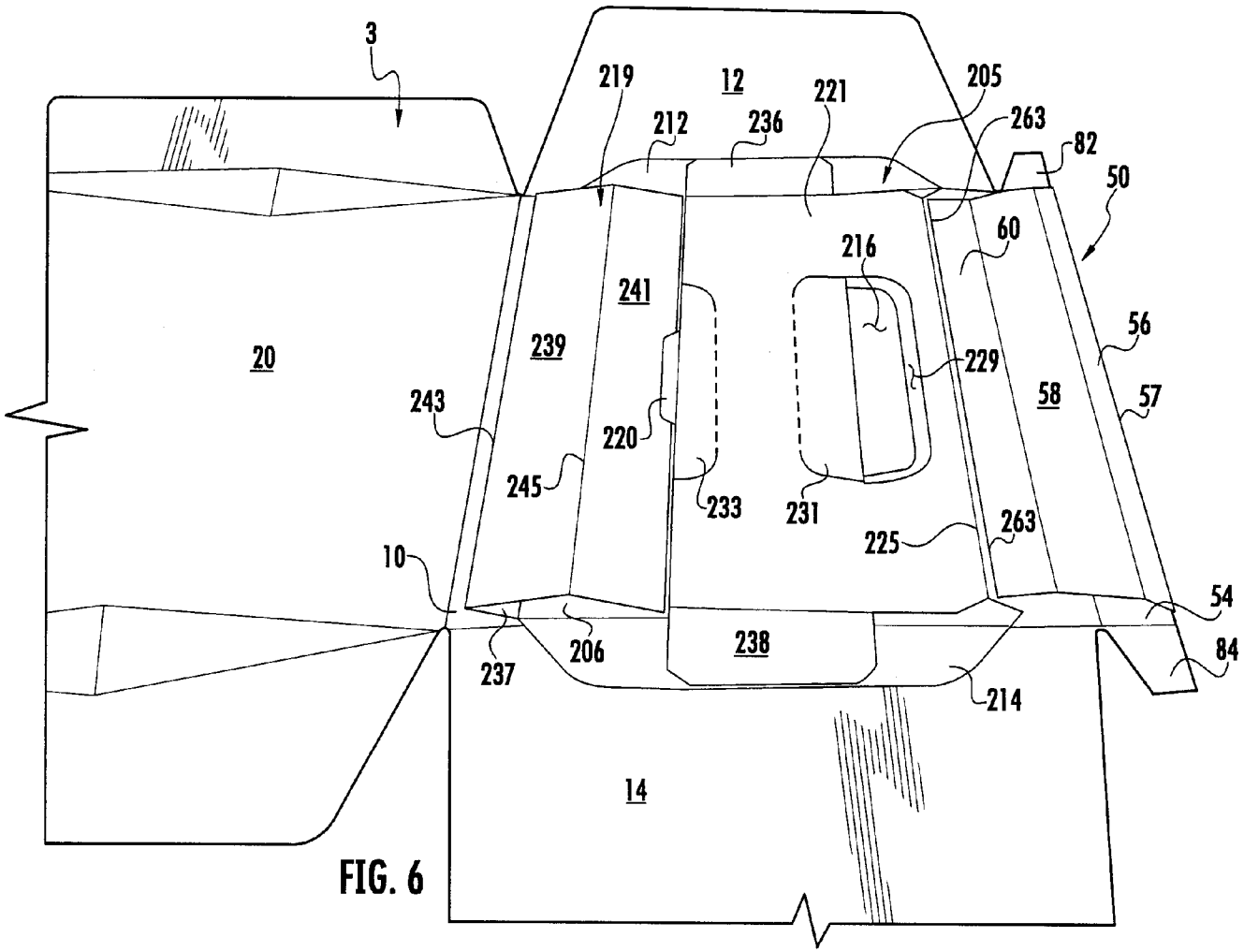
Figure 7:
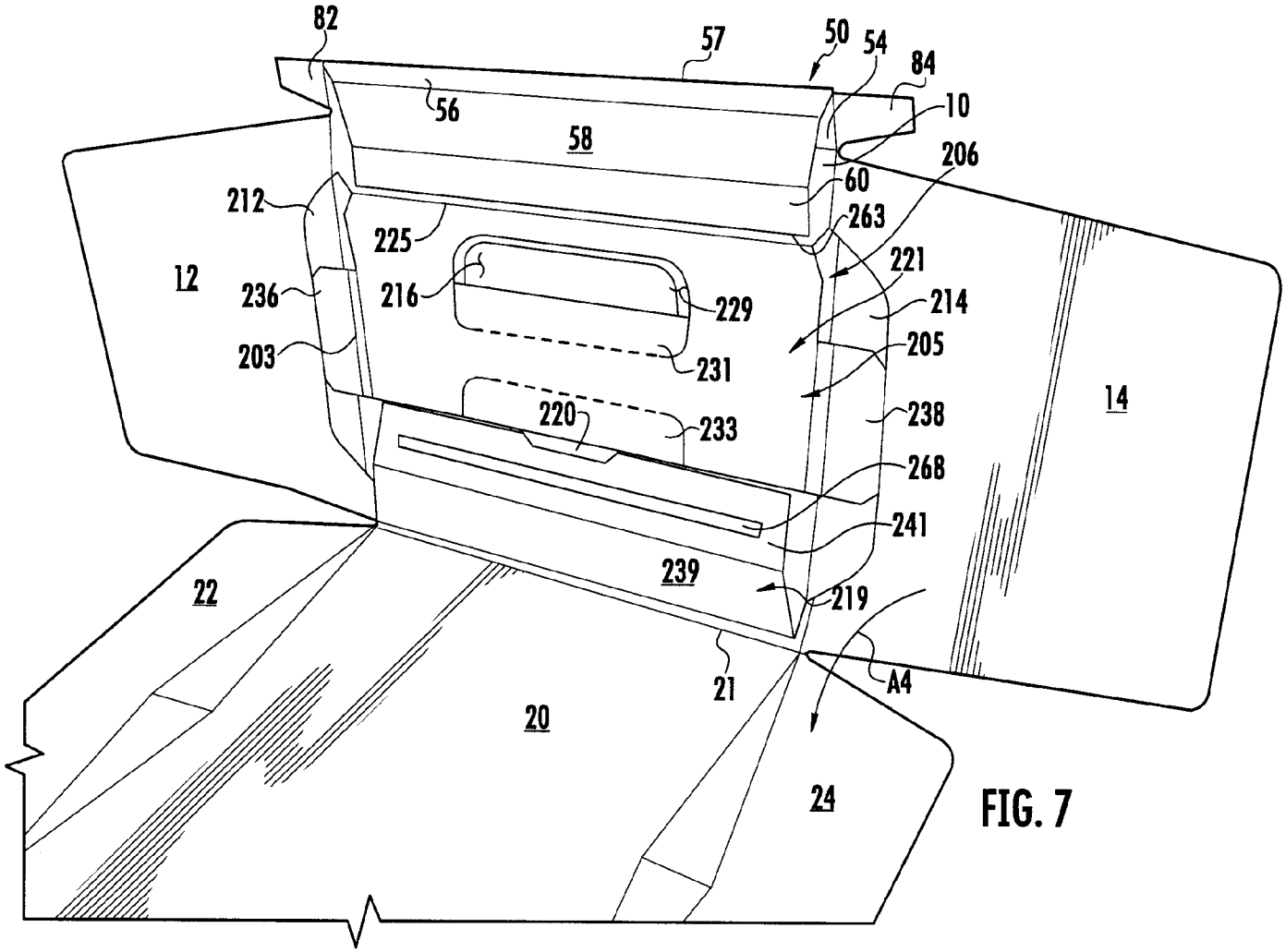

As shown in FIG. 5, the first reinforcing side flap 219 can be folded about fold line 243 in the direction of arrow A3 to position the reinforcing side flap 219 as shown in FIG. 6 so that the intermediate portion 239 and the distal portion 241 of the first reinforcing side flap 219 are at least partially in face-to-face contact with the central panel 206. In one embodiment, a portion of the distal portion 241 of the first reinforcing side flap 219 can be temporarily tucked under the tab 220 in the central panel 206 (FIG. 6). As shown in FIG. 7, glue can be applied to the interior surface of the distal portion 241 of the reinforcing side flap 219 in a strip 268. The top panel 10, with the insert 205 partially assembled, can be folded about fold line 21 in the direction of arrow A4 so that the distal portion 241 of the first reinforcing side flap 219 is attached to the side panel 20 by the glue strip 268. Also, the second reinforcing side flap 221 and the corner reinforcement flap 50 are brought into face-to-face contact with the side panel 20, when the top panel is downwardly folded from the position of FIG. 7.

Figure 8:
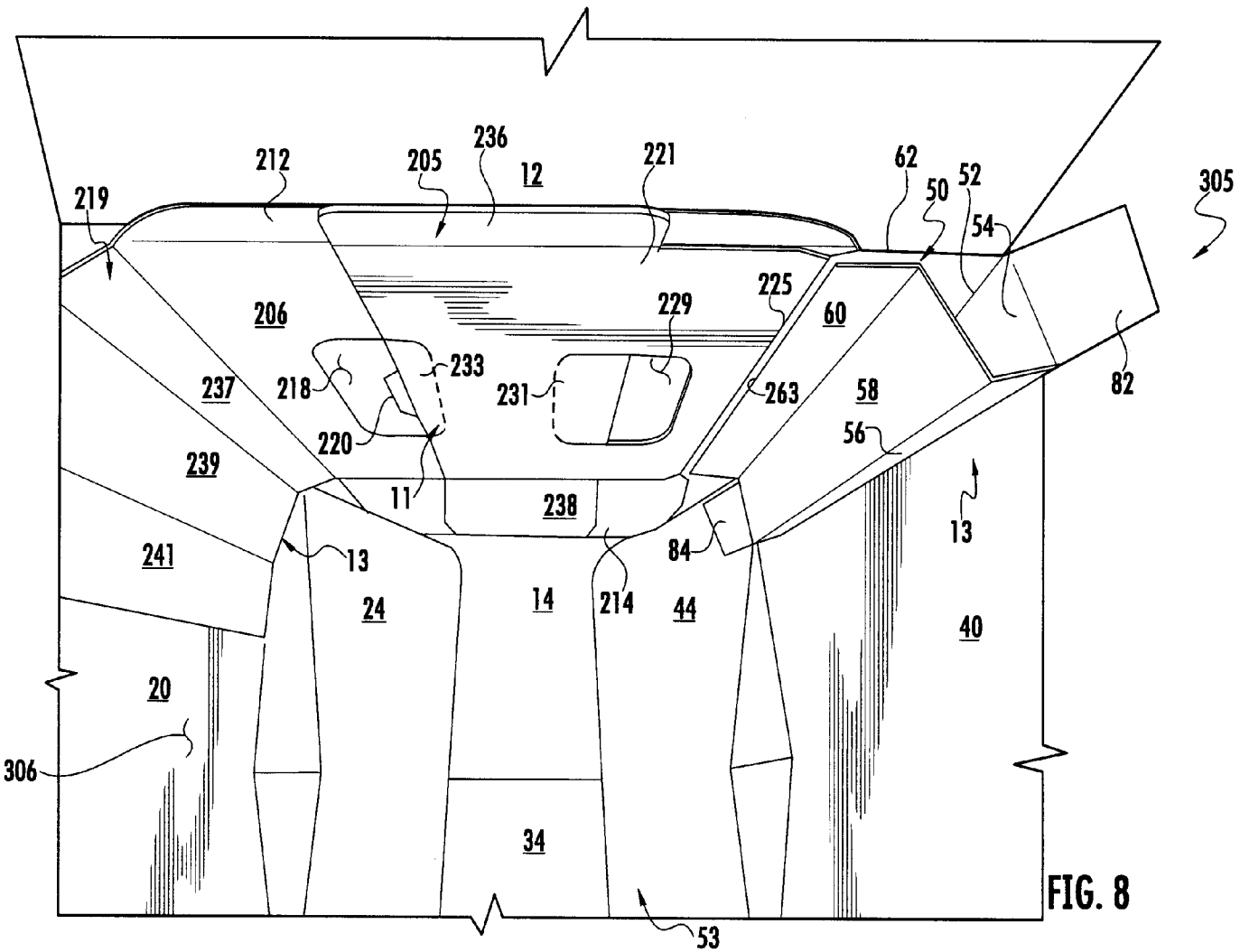
FIGS. 8 and 9 are perspective views of the interior of an open-ended sleeve formed from the insert blank of FIG. 2 and the carton blank of FIG. 1.

In the illustrated embodiment, the second side panel 40 and the bottom panel 30 of the carton blank 3 are folded along fold line 31 so that the top portion of the second side panel 40 can be glued in face-to-face contact to the exterior surface of the first portion 54 of the corner reinforcement flap 50. As shown in FIGS. 8 and 9, the carton blank 3 and the reinforcing insert 205 are further positioned and formed into a generally open-ended sleeve 305. The carton blank 3 can be folded about fold lines 21, 31, 41, 52 to position the side panels 20, 40, the top panel 10, and the bottom panel 30 to form the sleeve 305 with an interior 306. The corner reinforcement flap 50 is configured to stabilize the row of containers C that is adjacent to the second side panel 40. As shown in FIGS. 8 and 9, the second portion 56 and the third portion 58 of the corner reinforcement flap 50 remain unattached to the blank 3 (e.g., the top panel 10 and side panel 40). Accordingly, the second portion 56 can extend generally inwardly from the second side panel 40, and the third portion 58 can extend generally upwardly from the second portion 56 to the fourth portion 60, which is in face-to-face contact with the top panel 10. As shown in FIG. 9, at least the sides of the top portions T of the containers C can abut at least the third portion 58 of the corner reinforcement flap 50 to stabilize the containers in the carton 5. The corner reinforcement flap 50 could be otherwise shaped, arranged, configured, and/or omitted without departing from the disclosure.

In the illustrated embodiment, the first reinforcing side flap 219 disengages from the tab 220 as the sleeve 305 is erected, and the first reinforcing side flap 219 extends generally downwardly from the central panel 206 of the insert 205 in a manner that reinforces the row of containers C adjacent to the first side panel 20. The distal portion 241 of the first reinforcing side flap 219 is adhesively secured in face-to-face contact to the first side panel 20 as described above. The intermediate portion 239 and the proximal portion 237 are free from attachment to either the side panel 20 or top panel 10 of the carton blank 3 so that at least the sides of the top portions T of the containers C that are adjacent the first side panel 20 can contact the intermediate portion 239 and/or the proximal portion 237. The intermediate portion 239 can extend upwardly from the distal portion 241 and be positioned at an oblique angle relative to the side panel 20 and the top panel 10, and the proximal portion 237 can extend upwardly from the intermediate portion 239 and be positioned at an oblique angle relative to the top panel 10 and the side panel 20. The proximal portion 237 and the intermediate portion 239 can be positioned at the same oblique angle or different oblique angles. The reinforcing features of the insert 205 could be otherwise shaped, arranged, configured, and/or omitted without departing from the disclosure.

As shown in FIGS. 8 and 10, the first end 51 of the carton 5 can be closed by respectively overlapping and adhering the side end flaps 22, 42, the top and bottom end flaps 12, 32, and the corner end flap 82. As the top end flap 12 is folded downwardly, the top end flap 12 contacts the reinforcing end flap 212, which, in turn, contacts the inner reinforcing end flap 236. Accordingly, the top end flap 12 folds the reinforcing end flap 212 and the inner reinforcing end flap 236 downwardly as the first end 51 is closed. At least the top end flap 12, the reinforcing end flap 212, the inner reinforcing end flap 236, and the upper portions of the side end flaps 22, 42 are angled inwardly in the closed first end 51.

In the illustrated embodiment, the second end 53 has similar features as the first end 51 and can be closed in substantially the same manner as the first end 51. The closed second end 53 is shown in FIG. 10. The containers C can be loaded into the carton 5 after closing one of the ends 51, 53, or before closing either end. At least the top end flap 14, the reinforcing end flap 214, the inner reinforcing end flap 238, and the upper portions of the side end flaps 24, 44 are angled inwardly in the closed second end 53. Alternatively, the second end 53 can be otherwise configured or closed in a different manner than the first end 51 without departing from the scope of the disclosure. Additionally, alternative assembling, loading, and closing steps may be used without departing from the scope of the disclosure.

In the illustrated embodiment, the top portions T of the containers C that are adjacent the first end 51 and the second end 53 can abut the respective tapered upper portions 81, 83 of the respective closed ends 51, 53 to help restrain the containers. Accordingly, the containers adjacent the first closed end 51 can contact at least the top end flap 12, the reinforcing end flap 212, the inner reinforcing end flap 236, and the upper portions of the side end flaps 22, 42, and the containers C adjacent the second closed end 53 an contact at least the top end flap 14, the reinforcing end flap 214, the inner reinforcing end flap 238, and the upper portions of the side end flaps 24, 44.

The first reinforcing side flap 219 of the insert 205 and the corner reinforcing flap 50 form the container-restraining structure 13, as shown in FIGS. 8 and 9. Accordingly, the first reinforcing side flap 219 and the corner reinforcement flap 50 provide restraint to the tops T for the containers C that are adjacent the side panels 20, 40 of the carton 5. In this manner, the container-restraining structure 13 cooperates with the tapered portions of the ends 51, 53 to help prevent excessive movement of the containers C in the carton 5.

In the illustrated embodiment, the reinforcing side flap 221 overlays the features of the handle 11 to reinforce the handle and increase the strength of the carton 5. The reinforcing handle features of the insert 205 could be otherwise shaped, arranged, configured, and/or omitted without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprises a top panel, a first side panel foldably connected to the top panel, a bottom panel foldably connected to the first side panel, a second side panel foldably connected to the bottom panel, and a corner reinforcement flap foldably connected to the top panel;

a reinforcing insert comprising a central panel and at least one reinforcing side flap, the central panel being at least partially in face-to-face contact with at least a portion of the top panel; and a container-restraining structure comprising the at least one reinforcing side flap being positioned adjacent the first side panel to restrain at least one container of the plurality of containers that is adjacent the first side panel, and the corner reinforcement flap positioned adjacent the second side panel to restrain at least one container of the plurality of containers that is adjacent the second side panel;

wherein the at least one reinforcing side flap comprises a proximal portion foldably connected to the central panel, an intermediate portion foldably connected to the proximal portion, and a distal portion foldably connected to the intermediate portion, and wherein the distal portion of the at least one reinforcing side flap is at least partially in face-to-face contact with the first side panel.

2. The carton of claim 1, wherein:

each of the proximal portion and the intermediate portion of the at least one reinforcing side flap extends in an oblique direction;

the corner reinforcement flap comprises a first portion foldably connected to the top panel, a second portion foldably connected to the first portion, a third portion foldably connected to the second portion, and a fourth portion foldably connected to the third portion;

the first portion of the corner reinforcement flap is at least partially in face-to-face contact with the side panel, the fourth portion of the corner reinforcement flap is at least partially in face-to-face contact with the top panel adjacent the central panel, and the second portion and the third portion of the corner reinforcement flap extend into the interior of the carton from the respective first and fourth portions of the corner reinforcement flap.

3. The carton of claim 1, wherein:

the at least one reinforcing side flap comprises a first reinforcing side flap, and the reinforcing insert further comprises a second reinforcing side flap foldably connected to the central panel; and the second reinforcing side flap is at least partially in face-to-face contact with the central panel.

4. The carton of claim 3, further comprising a handle comprising features extending in at least the top panel, the central panel, and the second reinforcing side flap.

5. The carton of claim 1, wherein:

the corner reinforcement flap comprises a first portion foldably connected to the top panel, a second portion foldably connected to the first portion, a third portion foldably connected to the second portion, and a fourth portion foldably connected to the third portion; and the first portion of the corner reinforcement flap is secured at least partially in face-to-face contact with the side panel, the fourth portion of the corner reinforcement flap is secured at least partially in face-to-face contact with the top panel adjacent the central panel, and the second portion and the third portion of the corner reinforcement flap extend into the interior of the carton from the respective first and fourth portions of the corner reinforcement flap.

6. The carton of claim 5, wherein the second portion of the corner reinforcement flap extends generally parallel to the top panel, and the third portion of the corner reinforcement flap extends in an oblique direction.

7. The carton of claim 5, wherein:

the at least one reinforcing side flap is foldably connected to the central panel along a transverse fold line;

the at least one reinforcing side flap is at least partially in face-to-face contact with the central panel; and the fourth portion of the corner reinforcement flap is at least partially in face-to-face contact with the top panel adjacent the transverse fold line.

8. The carton of claim 3, further comprising at least two end flaps respectively foldably connected to respective panels of the plurality of panels, the at least two end flaps comprising a top end flap foldably connected to the top panel, wherein:

the end flaps are overlapped with respect to one another and thereby at least partially form a closed end of the carton;

the central panel comprises at least one reinforcing end flap foldably connected to the central panel; and the at least one reinforcing end flap is at least partially in face-to-face contact with the top end flap.

9. A carton for holding a plurality of containers, the carton comprising:

a plurality of panels that extends at least partially around an interior of the carton, the plurality of panels comprises a top panel, a first side panel foldably connected to the top panel, a bottom panel foldably connected to the first side panel, a second side panel foldably connected to the bottom panel, and a corner reinforcement flap foldably connected to the top panel;

a reinforcing insert comprising a central panel and at least one reinforcing side flap, the central panel being at least partially in face-to-face contact with at least a portion of the top panel;

a container-restraining structure comprising the at least one reinforcing side flap being positioned adjacent the first side panel to restrain at least one container of the plurality of containers that is adjacent the first side panel, and the corner reinforcement flap positioned adjacent the second side panel to restrain at least one container of the plurality of containers that is adjacent the second side panel; and at least two end flaps respectively foldably connected to respective panels of the plurality of panels, the at least two end flaps comprising a top end flap foldably connected to the top panel, wherein:

the end flaps are overlapped with respect to one another and thereby at least partially form a closed end of the carton;

the central panel comprises at least one reinforcing end flap foldably connected to the central panel; and the at least one reinforcing end flap is at least partially in face-to-face contact with the top end flap, wherein at least a portion of the top end flap and the at least one reinforcing end flap extend in an oblique direction with respect to the top panel so that the at least one reinforcing end flap is positioned to restrain at least one container of the plurality of containers that is adjacent the closed end of the carton.

10. The carton of claim 8, wherein:

at least one inner reinforcing end flap is foldably connected to the second reinforcing side flap and is in face-to-face contact with at least a portion of the at least one reinforcing end flap.

11. In combination, a carton blank and an insert blank for forming a carton having container-restraining features for restraining movement of containers in the carton, the carton blank comprising:

a plurality of panels comprising a top panel, a first side panel foldably connected to the top panel, a bottom panel foldably connected to the first side panel, a second side panel foldably connected to the bottom panel, and a corner reinforcement flap foldably connected to the top panel;

the insert blank comprising:

a central panel and at least one reinforcing side flap foldably connected to the central panel, the central panel for being positioned at least partially in face-to-face contact with at least a portion of the top panel;

wherein the container-restraining features comprise the at least one reinforcing side flap that is for being positioned adjacent the first side panel to restrain at least one container of the plurality of containers that is adjacent the first side panel, and the corner reinforcement flap that is for being positioned adjacent the second side panel to restrain at least one container that is adjacent the second side panel in the carton formed from the carton blank and the insert blank, wherein the at least one reinforcing side flap comprises a proximal portion foldably connected to the central panel, an intermediate portion foldably connected to the proximal portion, and a distal portion foldably connected to the intermediate portion, and wherein the distal portion of the at least one reinforcing side flap is at least partially in face-to-face contact with the first side panel.

12. The combination of claim 11, wherein:

each of the proximal portion and the intermediate portion of the at least one reinforcing side flap extends in an oblique direction when the carton is formed from the carton blank and the insert blank;

the corner reinforcement flap comprises a first portion foldably connected to the top panel, a second portion foldably connected to the first portion, a third portion foldably connected to the second portion, and a fourth portion foldably connected to the third portion;

the first portion of the corner reinforcement flap is for being positioned at least partially in face-to-face contact with the side panel and the fourth portion of the corner reinforcement flap is for being positioned at least partially in face-to-face contact with the top panel adjacent the central panel when the carton is formed from the carton blank and the insert blank.

13. The combination of claim 11, wherein:

the at least one reinforcing side flap comprises a first reinforcing side flap, and the insert blank further comprises a second reinforcing side flap foldably connected to the central panel; and the second reinforcing side flap is for being positioned at least partially in face-to-face contact with the central panel in the carton formed from the carton blank and the insert blank.

14. The combination of claim 13, further comprising a handle comprising features extending in at least the top panel, the central panel, and the second reinforcing side flap.

15. The combination of claim 11, wherein:

the corner reinforcement flap comprises a first portion foldably connected to the top panel, a second portion foldably connected to the first portion, a third portion foldably connected to the second portion, and a fourth portion foldably connected to the third portion; and the first portion of the corner reinforcement flap is for being secured at least partially in face-to-face contact with the side panel and the fourth portion of the corner reinforcement flap is for being secured at least partially in face-to-face contact with the top panel adjacent the central panel when the carton is formed from the carton blank and the insert blank.

16. The combination of claim 15, wherein the first portion of the corner reinforcement flap comprises at least one corner end flap.

17. The combination of claim 13, further comprising at least two end flaps respectively foldably connected to respective panels of the plurality of panels, the at least two end flaps comprising a top end flap foldably connected to the top panel, wherein the central panel comprises at least one reinforcing end flap foldably connected to the central panel, and the at least one reinforcing end flap is for being positioned at least partially in face-to-face contact with the top end flap in the carton formed from the carton blank and the insert blank.

18. In combination, a carton blank and an insert blank for forming a carton having container-receiving features for restricting movement of containers in the carton, the carton blank comprising:

a plurality of panels comprising a top panel, a first side panel foldably connected to the top panel, a bottom panel foldably connected to the first side panel, a second side panel foldably connected to the bottom panel, and a corner reinforcement flap foldably connected to the top panel;

the insert blank comprising:

a central panel and at least one reinforcing side flap foldably connected to the central panel, the central panel for being positioned at least partially in face-to-face contact with at least a portion of the top panel;

wherein the container-restraining features comprise the at least one reinforcing side flap that is for being positioned adjacent the first side panel to restrain at least one container of the plurality of containers that is adjacent the first side panel, and the corner reinforcement flap that is for being positioned adjacent the second side panel to restrain at least one container that is adjacent the second side panel in the carton formed from the carton blank and the insert blank; and at least two end flaps respectively foldably connected to respective panels of the plurality of panels, the at least two end flaps comprising a top end flap foldably connected to the top panel, wherein the central panel comprises at least one reinforcing end flap foldably connected to the central panel, and the at least one reinforcing end flap is for being positioned at least partially in face-to-face contact with the top end flap in the carton formed from the carton blank and the insert blank, wherein at least a portion of the top end flap and the at least one reinforcing end flap extend in an oblique direction with respect to the top panel so that the at least one reinforcing end flap is positioned to restrain at least one container of the plurality of containers that is adjacent a closed end of the carton formed from the carton blank and the insert blank.

19. The combination of claim 17, wherein:

at least one inner reinforcing end flap is foldably connected to the at least one second reinforcing side flap and is for being positioned in face-to-face contact with at least a portion of the at least one reinforcing end flap when the carton is formed from the carton blank and the insert blank.

20. A method of forming a carton comprising:

obtaining a carton blank comprising a plurality of panels comprising a top panel, a first side panel foldably connected to the top panel, a bottom panel foldably connected to the first side panel, a second side panel foldably connected to the bottom panel, and a corner reinforcement flap foldably connected to the top panel;

obtaining an insert blank comprising a central panel and at least one reinforcing side flap foldably connected to the central panel;

positioning the insert blank relative to the carton blank so that the central panel overlaps at least a portion of the top panel;

forming an interior of the carton at least partially defined by the plurality of panels; and forming a container-restraining structure comprising the at least one reinforcement side flap and the corner reinforcement flap, wherein the forming the container-restraining structure comprises positioning the at least one reinforcing side flap adjacent the first side panel for restraining at least one container adjacent the first side panel and positioning the corner reinforcement flap adjacent the second side panel for restraining at least one container adjacent the second side panel in the interior of the carton, wherein the at least one reinforcing side flap comprises a proximal portion foldably connected to the central panel, an intermediate portion foldably connected to the proximal portion, and a distal portion foldably connected to the intermediate portion, and wherein the distal portion of the at least one reinforcing side flap is at least partially in face-to-face contact with the first side panel.

21. The method of claim 20, wherein the forming the interior of the carton comprises:

securing a first portion of the corner reinforcing flap to the top panel adjacent the central panel; and folding the first side panel, the bottom panel, and the second side panel around the interior of the carton and securing a second portion of the corner reinforcing flap to the second side panel.

22. The method of claim 21, wherein the positioning the corner reinforcement flap comprises folding at least a third portion of the corner reinforcement flap to extend into the interior of the carton from at least one of the first portion and the second portion of the corner reinforcing flap.

23. The method of claim 20, wherein the positioning the at least one reinforcing side flap for restraining at least one container further comprises securing the distal portion of the at least one reinforcing side flap to the first side panel.

24. The method of claim 20, wherein:

the at least one reinforcing side flap comprises a first reinforcing side flap, and the insert blank further comprises a second reinforcing side flap foldably connected to the central panel; and the method further comprises securing the second reinforcing side flap at least partially in face-to-face contact with the central panel to reinforce the top panel.

25. The carton of claim 1, wherein:

the intermediate portion of the at least one reinforcing side flap is configured to restrain the at least one container of the plurality of containers that is adjacent the first side panel.

* * * * *